US011546687B1

(12) United States Patent
Delikaris Manias et al.

(10) Patent No.: US 11,546,687 B1
(45) Date of Patent: Jan. 3, 2023

(54) HEAD-TRACKED SPATIAL AUDIO

(71) Applicant: Apple Inc., Cupertino, CA (US)

(72) Inventors: Symeon Delikaris Manias, Los Angeles, CA (US); Shai Messingher Lang, Santa Clara, CA (US); Juha O. Merimaa, San Mateo, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/392,069

(22) Filed: Aug. 2, 2021

Related U.S. Application Data

(60) Provisional application No. 63/079,761, filed on Sep. 17, 2020.

(51) Int. Cl.
*H04R 1/32* (2006.01)

(52) U.S. Cl.
CPC ..... *H04R 1/326* (2013.01); *H04R 1/323* (2013.01); *H04R 2430/23* (2013.01); *H04R 2460/07* (2013.01)

(58) Field of Classification Search
None
See application file for complete search history.

(56) References Cited

U.S. PATENT DOCUMENTS

| | | | | |
|---|---|---|---|---|
| 2013/0064375 | A1 | 3/2013 | Atkins et al. | |
| 2019/0253821 | A1* | 8/2019 | Buchner | H04R 5/04 |
| 2020/0137489 | A1 | 4/2020 | Sheaffer et al. | |
| 2020/0245092 | A1* | 7/2020 | Badhwar | H04L 65/60 |

OTHER PUBLICATIONS

Delikaris-Manias, Symeon, et al., "Parametric Binaural Rendering Utilizing Compact Microphone Arrays," ICASSP 2015, Aug. 2015, 5 pages.

* cited by examiner

*Primary Examiner* — Kenny H Truong
(74) *Attorney, Agent, or Firm* — Womble Bond Dickinson (US) LLP

(57) ABSTRACT

Spatial filters are generated that map response of an audio capture device to head related transfer functions (HRTFs) for different positions of the audio capture device relative to the HRTFs. A current set of spatial filters are determined based on the plurality of spatial filters and a head position of a user. The microphone signals are convolved with the current set of spatial filters, resulting in a left audio channel and right audio channel that form output binaural audio channels. The binaural audio channels can be used to drive speakers of a headphone set to generate sound that is perceived to have a spatial quality. Other aspects are described and claimed.

20 Claims, 6 Drawing Sheets

HEAD-TRACKED SPATIAL AUDIO

CROSS-REFERENCE TO RELATED APPLICATION

This application claims the benefit of U.S. Provisional Patent Application No. 63/079,761 filed Sep. 17, 2020, which is incorporated by reference herein in its entirety.

FIELD

One aspect of the disclosure herein relates to head-tracked spatial audio.

BACKGROUND

Spatial audio rendering includes processing of an audio signal (such as a microphone signal or other recorded or synthesized audio content) so as to yield sound produced by a multi-channel speaker setup. Examples of speaker setups include stereo speakers, surround-sound loudspeakers, speaker arrays, and headphones. Sound produced by the speakers can be perceived by the listener as coming from a particular direction or all around the listener in three-dimensional space.

Head-tracked spatial audio is spatial audio that adjusts depending on a position of a user's head. For example, suppose that a sound, played through a headphone set, is rendered to be perceived as emanating from the left side of a user. If the user turns her head to the right by 90 degrees, then the audio processing should render the sound so as to be perceived behind the user. If not, then the sound will still be perceived as emanating to the left of the user, even though the user has turned her head, which is not how sound behaves in the real world. Thus, head-tracked spatial audio provides an improved spatial audio experience where sounds are spatially adjusted, dynamically, to reflect a user's head position, as in the real world.

SUMMARY

An audio system can capture a sound scene with one or more microphones (e.g., a microphone array). The microphone signals can be preprocessed to generate metadata defining arrangement of the microphones and/or directivity pattern of the microphones. The microphone signals and the metadata can be transmitted or shared by other means with other devices to generate spatial filters. At a rendering stage, audio output synthesis can be performed on the microphone signals by applying the spatial filters. Output audio channels are generated and used to drive speakers to produce spatialized sound.

There are different types of signal-independent spatial audio systems, such as, for example, channel-based, object-based, and scene-based audio. Channel-based coding generally focuses on a particular output audio format used at the reproduction end of the audio chain. If surround sound audio is to be played out in a room with a 5.1 speaker layout, then audio capture (e.g., microphone setup) is arranged to create the channels that would be fed to each of the six speakers of the 5.1 layout. The microphones are arranged so that the sound scene in the playback room matches the arrangement of the microphones as closely as possible. For a different configuration of speakers in a room (7.1, 7.4.1, 11.1, etc.), a different set of audio signals are generated to recreate a sound scene. Channel-based audio has some limitations, for example, the recreation of the audio scene is constrained to a particular playback set-up that typically requires a particular speaker count and speaker positions.

Object-based audio is less dependent on configuration of speakers than channel-based systems. Object-based audio manages discrete sound sources in a sound scene. Each sound source (object) can be represented by a position and sound signal. A spatial renderer uses the position information to spatially render the sound signal, thus spatially reproducing the sound source. Object-based audio, however, also has limitations. For example, if a number of sound sources increases to a large amount, it becomes impractical to represent each sound source as a discrete object, due to processing, bandwidth, and/or memory constraints.

Scene-based audio coding provides some improvements in capture, representation, and rendering of spatial audio, as compared to object-based and channel-based audio coding. Scene-based audio captures and represents sound pressure at different locations, in 3-dimensional space, and for different instances in time. In some approaches, virtual loudspeaker arrays can be used to capture a sound scene. In other approaches, spherical harmonics can be used to represent pressure values at positions in 3D space with an acceptably small footprint but with a high accuracy. Spherical harmonics represent the pressure values at different points using spherical harmonic coefficients. Spherical harmonic transformation algorithms can be implemented to determine the coefficients. A few spatially separated microphones can generate microphone signals that can be processed with spherical harmonic transformation algorithms to generate the spherical harmonic coefficients (e.g., Ambisonics or Higher Order Ambisonics coefficients). These microphone signals and spherical harmonic coefficients represent the sound scene in a scene-based audio coding system. When representing the audio scene, conversion of microphone signals to a n intermediate format (e.g., ambisonics or virtual loudspeaker arrays) can include transforming time and amplitude differences in microphone signals to only amplitude differences. In the case of virtual loudspeaker arrays (e.g., beamforming), information can be lost between pick-up beams. Thus, such approaches also have some drawbacks.

In some aspects, a method includes generating and/or accessing a plurality of spatial filters that map a response (capture response) of an audio capture device having a plurality of microphones to a plurality of head related transfer functions (HRTFs) for a plurality of positions of the audio capture device relative to the HRTFs. A current set of spatial filters can be determined based on the plurality of spatial filters and a head position of a user. Microphone signals can be convolved with the current set of spatial filters, resulting in output binaural audio channels. Unlike the case with the creation of intermediate formats (e.g., Ambisonics or virtual loudspeakers), the time (or phase) and amplitude differences of the microphone signals are preserved. The microphone signals are converted to time and amplitude differences of the output format.

The output binaural audio channels can, in such a manner, be generated from the microphone signals without creating an intermediate format. The method can be performed continuously as a head position of the user potentially changes—thus providing head-tracked spatial audio that is directly generated from microphone signals. Such a method does not require prior information of the microphone input signals, however, details of the microphone array manifold can be used for beamforming, as described in other sections.

The method can be performed by a system, one or more electronic devices, and/or stored as instructions on computer-readable medium. In some aspects, the method can be performed by a mobile electronic device such as a tablet computer or mobile phone.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
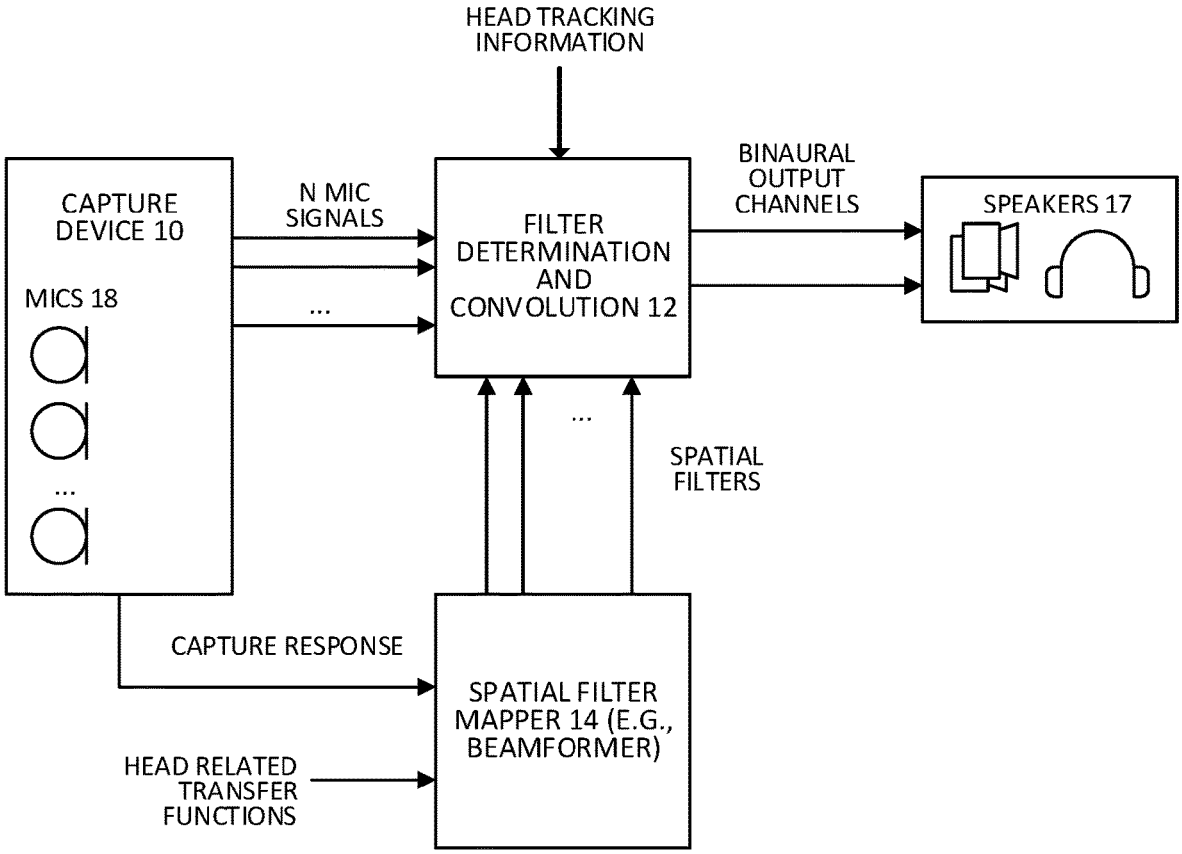
FIG. 1 shows an approach for generating head-tracked spatial audio, according to some aspects.

FIG. 1 shows an approach for generating head-tracked spatial audio, according to some aspects of the disclosure. An audio capture device 10 includes a plurality of N microphones 18 (e.g., one or more microphone arrays). Each microphone generates a respective microphone signal that has audio data representing a sound scene.

A spatial filter mapper 14 generates a plurality of spatial filters that map the capture response of the audio capture device to a plurality of head related transfer functions (HRTFs) for a plurality of positions of the audio capture device relative to the HRTFs. The HRTFs can be expressed as pickup beams that are arranged at and about a user's left or right ear. In some aspects, a single best guess HRTF is used to cover a wide range of users. This HRTF can be determined based on routine test and experimentation to best cover all users or a targeted group of users. The capture response of the audio capture device can include positions of the microphones and/or directivity of each of the microphones. The directivity of a microphone can be described as a polar pattern of the microphone.

At filter determination and convolution block 12, a current set of spatial filters are determined based on the plurality of spatial filters and a head position of a user. Microphone signals are convolved with the current set of spatial filters, resulting in output binaural audio channels. In such a manner, rather than a single transform filter, the system can include N transformations that map the capture response of each microphone signal of the capture device using spatial filters corresponding to different directions. Head-tracking can be performed based on those filters (e.g., through interpolation). N sets of spatial filters (e.g., beamforming filters) can be applied to transform the N microphone signals to generate the output audio channels.

These output audio channels can be applied to speakers 17 to generate spatial audio. In particular, the output binaural audio channels can be applied to a left speaker and right speaker of a headphone set or a head mounted display, to produce spatial binaural audio. The output binaural channels are generated from the microphone signals without creating an intermediate format.

In some aspects, the microphone signals are transmitted by a recording and/or encoding device to an intermediate device, a decoding device, or a playback device. The spatial filter mapper can generate the spatial filters 'offline' (e.g., at an audio lab or recording studio). These spatial filters can be stored to individual decoding or playback devices. Additionally, or alternatively, the spatial filters can be made available on a networked device (e.g., a server) for a decoding or playback device to access. The spatial filters or sets thereof can be associated with different head positions and retrieved based on head position (e.g., with a look-up algorithm).

Figure 2:
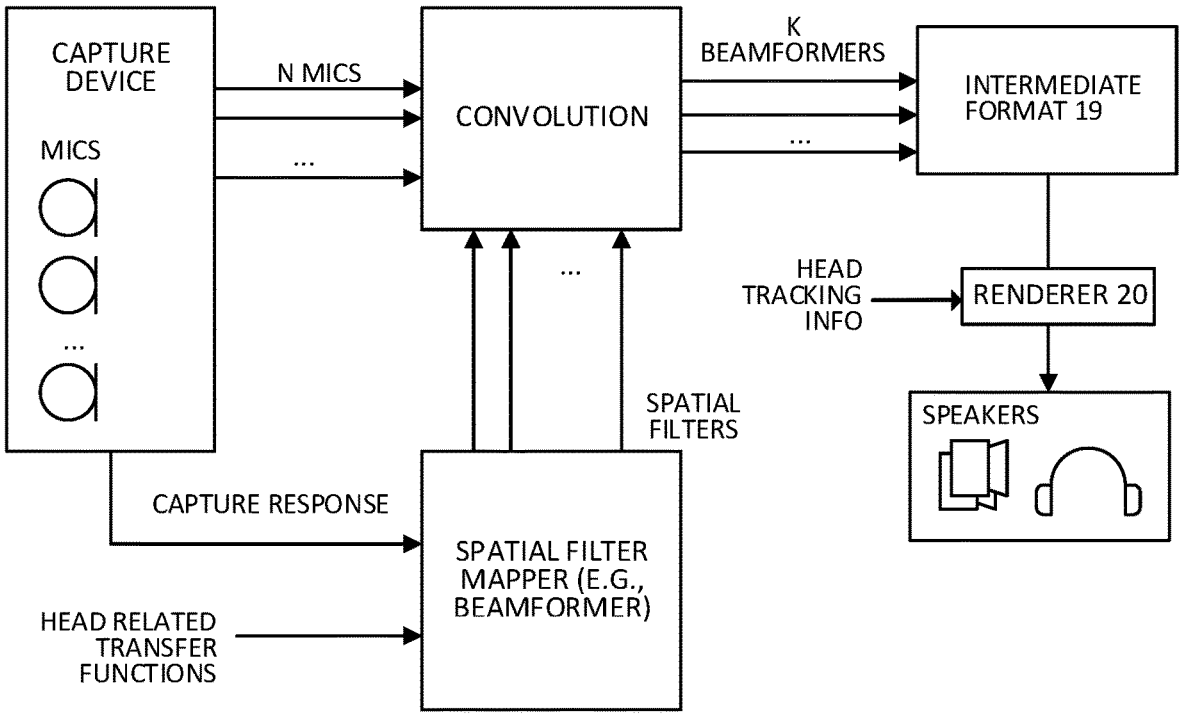
FIG. 2 shows another approach for generating head-tracked spatial audio.

FIG. 2 shows another approach for generating head-tracked spatial audio. This approach generates an intermediate format 19, such as, for example, Ambisonics or virtual loudspeakers. In this approach, spatial filters are applied to microphone signals to map those microphone signals to an intermediate format. Head tracking information can be applied to the intermediate format with a spatial audio renderer 20 to generate output audio channels, e.g., spatialized binaural audio. As discussed, however, creation of intermediate format 19 can result in loss of information (e.g., phase/time differences between the microphone signals) that can be retained under the approach shown in FIG. 1.

Referring back to FIG. 1, the user's head position (e.g., head tracking information) can be provided by one or more head-tracking systems. For example, the head position can be generated by one or more sensors integrated with a headphone set or head mounted display worn by the user. Sensors can include one or more cameras, gyroscopes, and/or accelerometers, inertial measurement units (IMUs). Head tracking algorithms can process the sensor data to determine head position. For example, visual odometry can be applied to camera images to determine head position. Similarly, motion tracking algorithms can be applied to IMU data to determine head position. Head position can be determined repeatedly over time to track a user's head as it moves. Head position can include least one of a roll, pitch, or yaw of the user's head. In some aspects, the head position includes all of a roll, pitch, and yaw of the user's head.

Determining the current set of spatial filters that are used to convolve the microphone signals can include selecting one or more of the plurality of spatial filters as the current set of spatial filters, based on the head position of the user. Each of the plurality of spatial filters can correspond to different positions of the user's head.

For example, the user's head position can be expressed in terms of spherical coordinates such as azimuth and elevation. Each set of spatial filters can be associated with a different head position (e.g., at a particular azimuth and elevation angle). If the user's head is at an azimuth of 120° and an elevation of −10°, then the set of spatial filters associated with 120° and −10° can be selected. Those selected filters are then used to convolve the microphone signals to generate spatialized binaural output channels with the head-tracking information of the user 'baked in' to the audio channels, so that sounds heard in the audio reflect the position of the user's head.

In some aspects, spatial filters may not be calculated and/or stored for each and every position of the user's head. The amount of spatial filters may vary depending on application. As the number of spatial filters (and corresponding head positions) that are calculated and stored increases, the spatial resolution of the spatial filter bank also increases. Increasing the number of spatial filters, however, also increases audio processing and storage overhead. Thus, in some aspects, spatial filters can be interpolated, to address when the user head position is not exactly aligned with any of the pre-calculated sets of spatial filters that are each associated with a particular head position.

Figure 3:
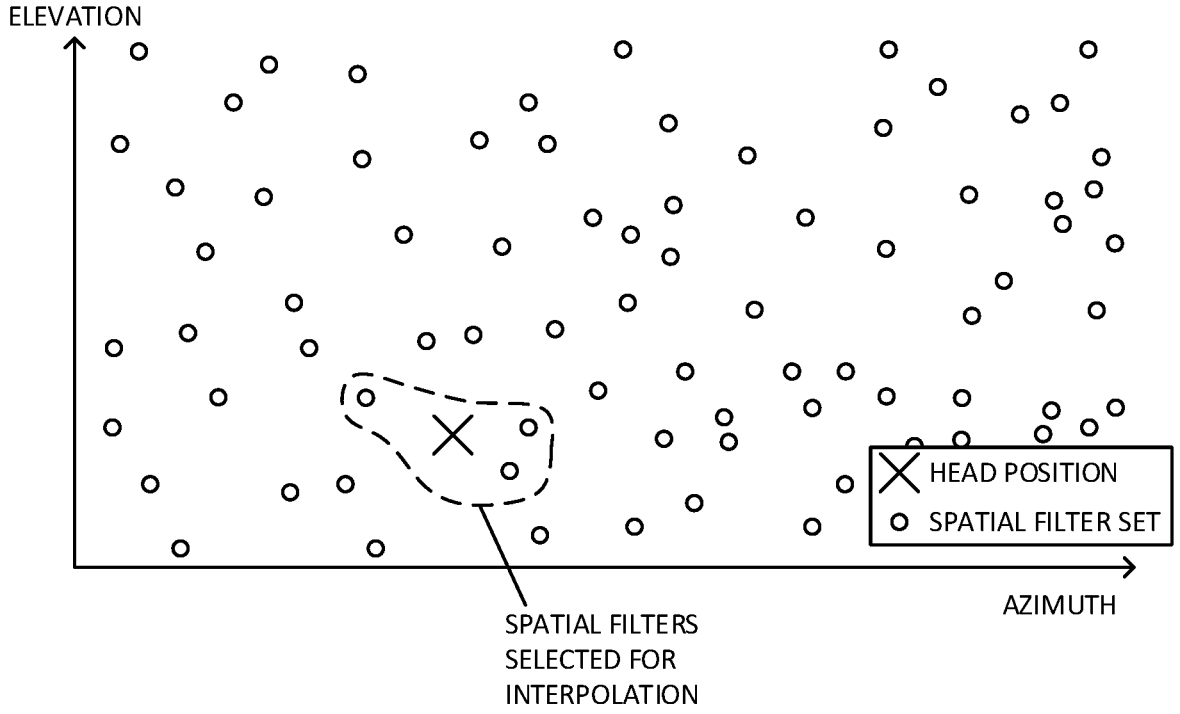
FIG. 3 shows an example of head-tracked spatial audio with interpolation, according to some aspects.

FIG. 3 shows an example of how spatial filters can be interpolated based on the head position of the user. Spatial filter sets are determined for different head positions, which can be expressed as spherical coordinates. If a user's head position is at an azimuth X and elevation Y, one or more nearby spatial filters can be selected that are adjacent to that particular head position (for example, the nearest set, or the nearest two sets, or the nearest three sets). Those spatial filters can be used to interpolate a new set of spatial filters at azimuth X and elevation Y. Interpolation can be performed as a linear interpolation, a polynomial interpretation, a triangulation, or other equivalent algorithm. As a result of the interpolation, a set of spatial filters are generated to reflect the head position of the user, even if spatial filters for a particular head position are not stored or previously calculated.

Figure 4:
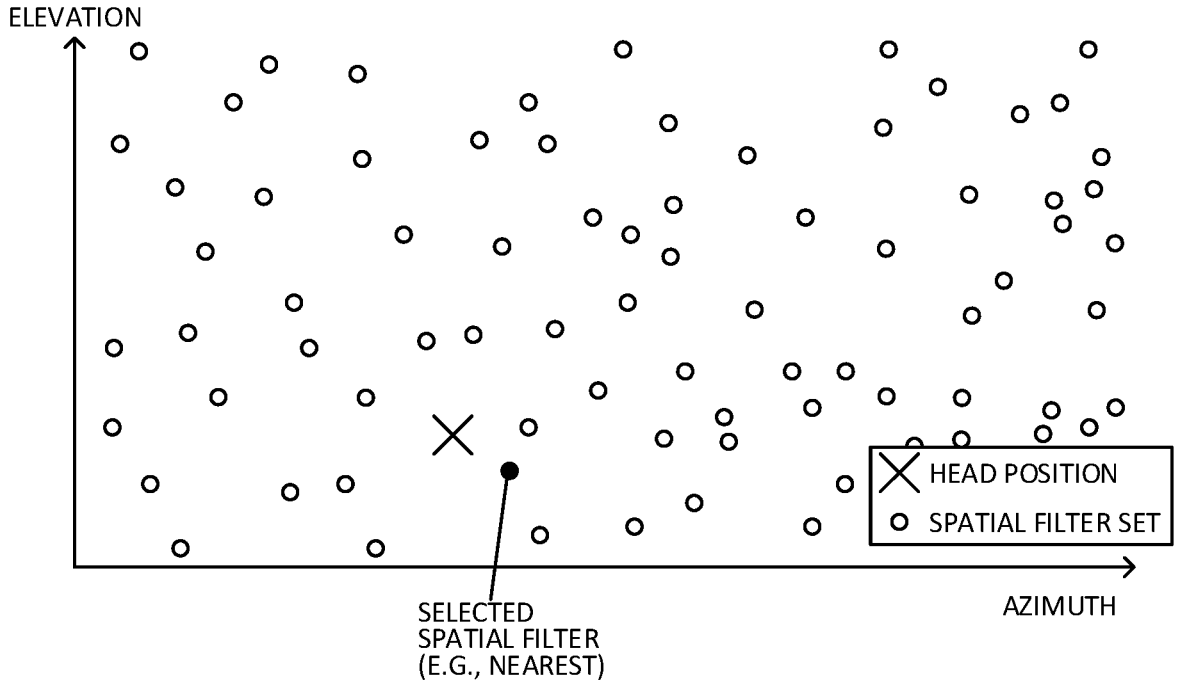
FIG. 4 shows an example of head-tracked spatial audio with selection of a spatial filter, according to some aspects.

In some aspects, as shown in FIG. 4, a spatial filter can be selected based on the user's head position. For example, a nearest set of spatial filters (e.g., one that is associated with a position that is nearest to the user's head position) can be selected and used to convolve the microphone signals. In some aspects, if the user's head position is within a threshold proximity to a position at which the set of spatial filters has been calculated and stored, then the nearest set of spatial filters is selected to be used to convolve the microphone signals. Otherwise, one or more spatial filters can be selected for interpolation to generate a new set of spatial filters to be used at that user head position. Thus, interpolation, which can consume processing resources, is used as a back-up when the pre-calculated spatial filters are not within a certain range of the user's head position.

Figure 5:
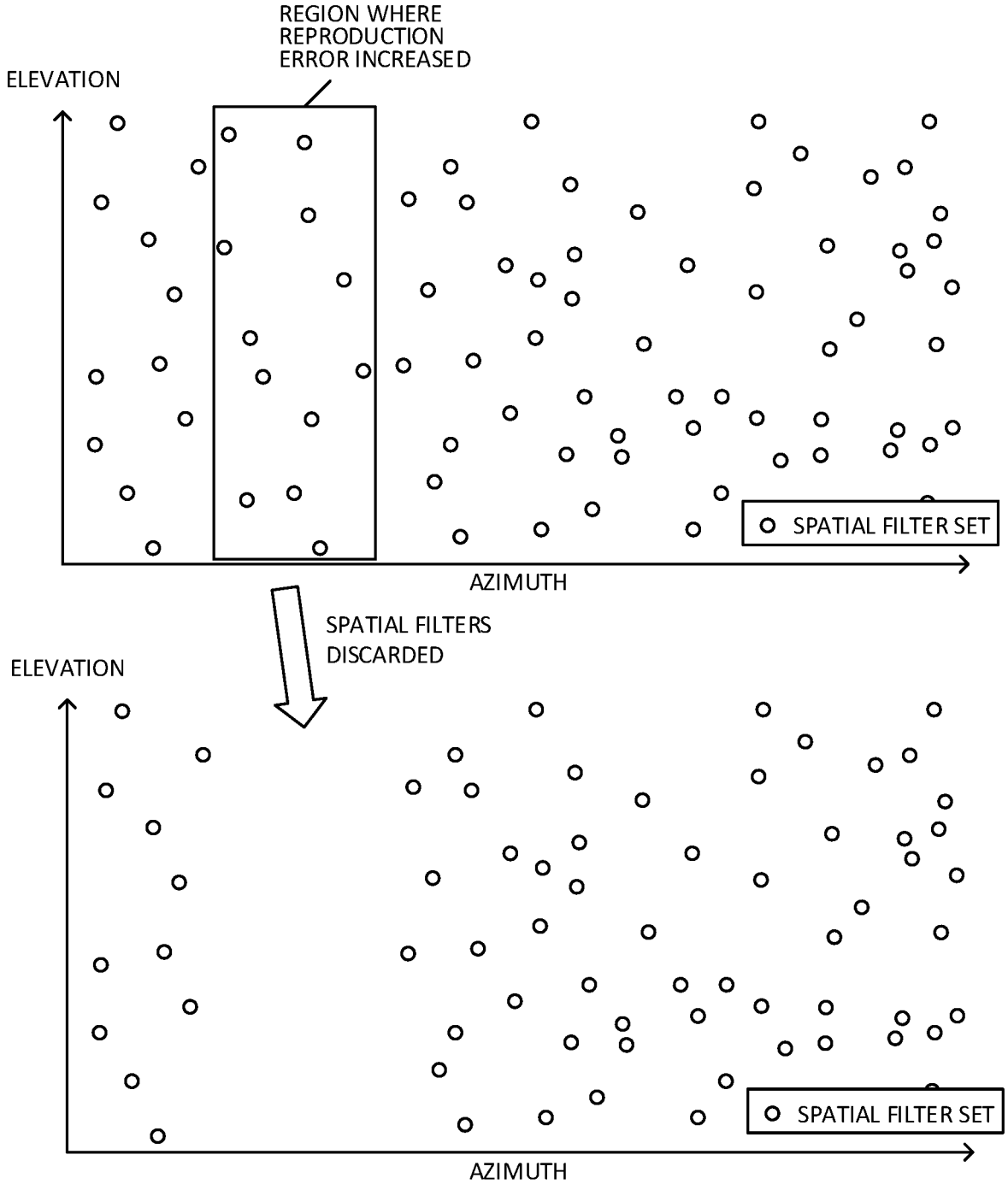
FIG. 5 shows an example of reproduction error of one or more spatial filters, according to some aspects.

FIG. 5 shows an example of how some spatial filters can have a higher reproduction error than others. For example, generation of some spatial filter sets (that map head positions to positions of a capture device) may result in mapping error when applied. This mapping error may be greater in some positions than others, or in some regions expressed in spherical coordinates. This can depend, for example, on the directivity pattern of the capture device and the position of the user's head relative to the capture device. For example, if a capture device has microphones that are aligned in a plane, and the capture device is rotated so that the plane is arranged normal to the user's head, such an arrangement may result in spatial filters that are prone to error. This error can be identified through test and experimentation and vary from one device to another. For those spatial filter sets (and/or regions) where the mapping error is above or exceeds a threshold (and/or otherwise deemed unacceptable), those spatial filter sets can be discarded (e.g., not stored and used for look-up). If a head position falls within a region or location where no spatial filter sets are stored, then a set of spatial filters can be generated as described in other sections (e.g., selected based on proximity or interpolated).

The spatial filters can include gains and phase delays or differences of each of the microphone signals. The spatial filters can be different for each microphone signal. A spatial filter set refers to a set of spatial filters for a plurality of microphones that are associated with a particular head direction The spatial filters can be stored on a computing device or on an external computing device in communication with the computing device (e.g., on the cloud). A look-up algorithm can be used to select a spatial filter set based on head position. It should be understood that the spatial filter sets that are not interpolated are pre-calculated (e.g., offline). In some aspects, the spatial filters are linear. In some aspects, the spatial filters are adaptive (e.g., varying over time).

Figure 6:
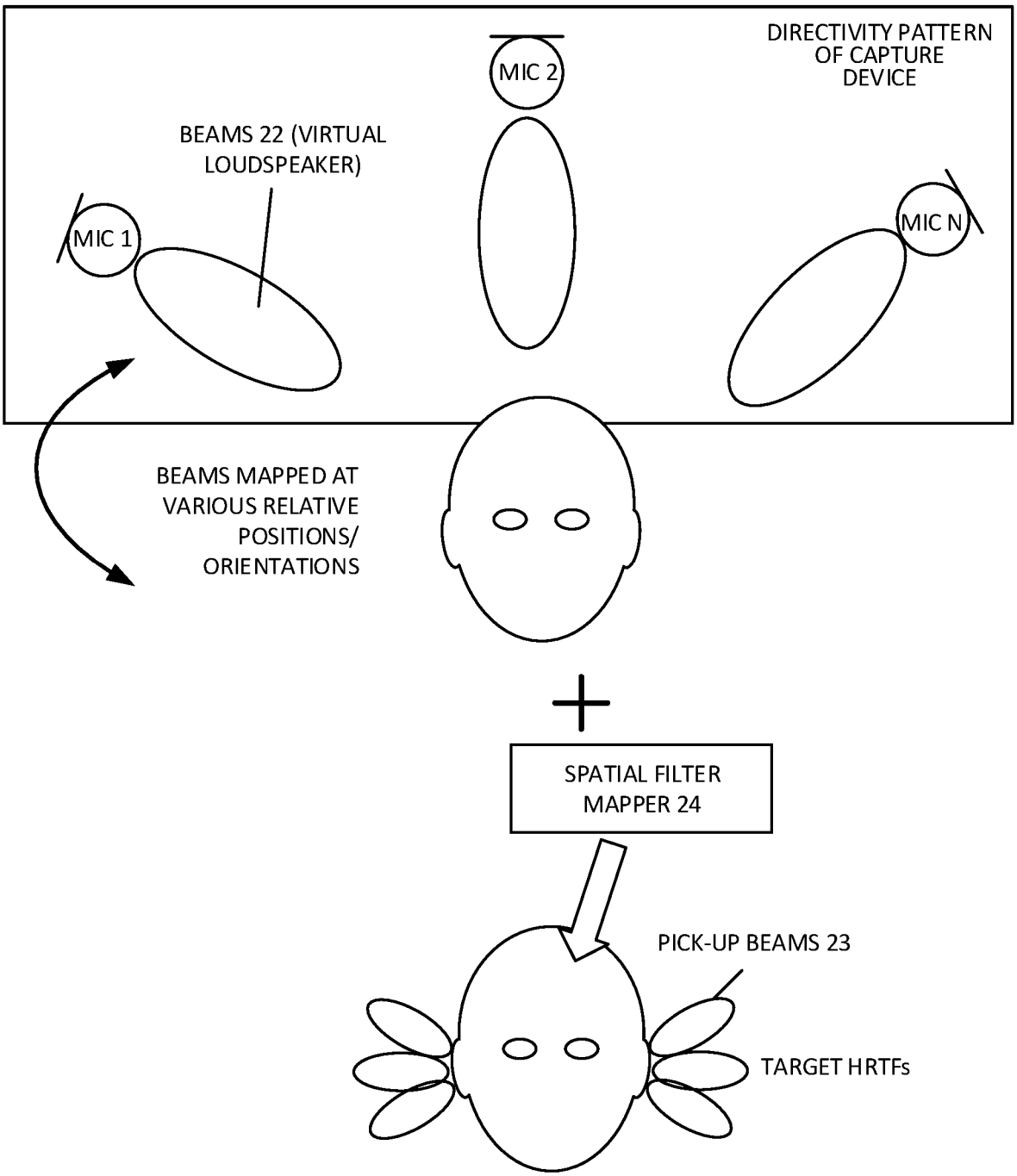
FIG. 6 shows an example of spatial filters and beamforming, according to some aspects.

In some aspects, the spatial filters are represented as beamforming filters (e.g., beamforming coefficients defining phase and gain for each microphone signal). Beamforming controls directionality of a speaker array or microphone array to target how wave energy (e.g., sound) is transmitted or received. Beamforming filters (defining phase and gain values) are applied to each of microphone signals or audio channels in order to create a pattern of constructive and destructive interference in a wave front. FIG. 6 illustrates an example of a spatial filter mapper 24 that generates a plurality of spatial filters that map a capture response of an audio capture device having a plurality of microphones to a plurality of head related transfer functions (HRTFs) for a plurality of positions of the audio capture device relative to the HRTFs. Virtual beamformed speakers 22 are generated based on directivity pattern of the plurality of microphones of the audio capture device.

For example, each beam can replicate the direction and polar pattern of each microphone of the capture device. Further, virtual beamformed microphone pickups are generated based on the HRTFs. For example, a plurality of pick-up beams 23 are generated at different directions relative to a head. Each beam can have different characteristics that represents a particular head related transfer function at a particular direction relative to a user's head.

The beamforming filters are generated by the spatial filter mapper such that the beamforming filters map the virtual beamformed speakers to the virtual beamformed microphone pickups. The beamforming filters can be generated at various positions of the capture device relative to the virtual pickup beams. Beamforming filter sets can each correspond to different head positions relative to the capture device. For example, the spatial filters can be determined to map from the capture device to the HRTFs at different rotations or directions of the capture device relative to a virtual listener (and respective HRTFs positioned about the virtual listener).

Figure 7:
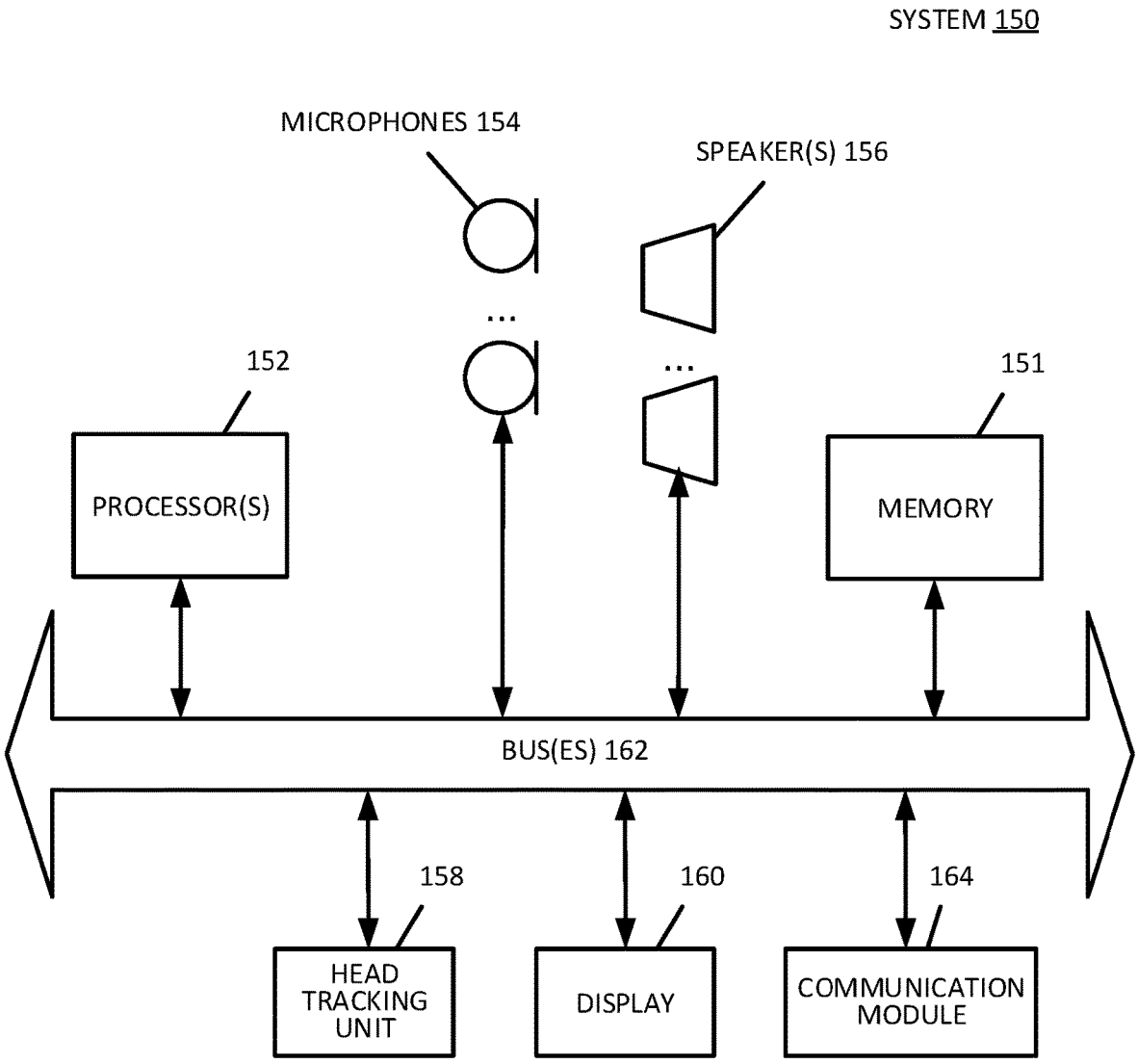
FIG. 7 shows an example audio system, according to some aspects.

FIG. 7 is an example implementation of the audio systems such as a capture device (or system) or a playback device (or system) described in other sections. Note that although this example shows various components of an audio processing system that may be incorporated into headphones, speaker systems, microphone arrays and entertainment systems, it is merely one example of a particular implementation and is merely to illustrate the types of components that may be present in the audio processing system. This example is not intended to represent any particular architecture or manner of interconnecting the components as such details are not germane to the aspects herein. It will also be appreciated that other types of audio processing systems that have fewer components than shown or more components than shown in this example audio system can also be used. For example, some operations of the process may be performed by electronic circuitry that is within a headset housing while others are performed by electronic circuitry that is within another device that is communication with the headset housing, e.g., a smartphone, an in-vehicle infotainment system, or a remote server. Accordingly, the processes described herein are not limited to use with the hardware and software shown in this example in FIG. 7.

FIG. 7 is an example implementation of the audio systems and methods described above in connection with other figures of the present disclosure, that have a programmed processor 152. The components shown may be integrated within a housing, such as that of a smart phone, a smart speaker, a tablet computer, a head mounted display, head-worn speakers, or other electronic device described in the present disclosure. These include one or more microphones 154 which may have a fixed geometrical relationship to each other (and are therefore treated as a microphone array.) The audio system 150 can include speakers 156, e.g., ear-worn speakers or loudspeakers.

The microphone signals may be provided to the processor 152 and to a memory 151 (for example, solid state non-volatile memory) for storage, in digital, discrete time format, by an audio codec. The processor 152 may also communicate with external devices via a communication module 164, for example, to communicate over the internet. The processor 152 is can be a single processor or a plurality of processors.

The memory 151 has stored therein instructions that when executed by the processor 152 perform the processes described herein the present disclosure. Note that some of these circuit components, and their associated digital signal processes, may be alternatively implemented by hardwired logic circuits (for example, dedicated digital filter blocks, hardwired state machines.) The system can include one or more cameras 158, and/or a display 160 (e.g., a head mounted display).

Various aspects descried herein may be embodied, at least in part, in software. That is, the techniques may be carried out in an audio processing system in response to its processor executing a sequence of instructions contained in a storage medium, such as a non-transitory machine-readable storage medium (for example DRAM or flash memory). In various aspects, hardwired circuitry may be used in combination with software instructions to implement the techniques described herein. Thus the techniques are not limited to any specific combination of hardware circuitry and software, or to any particular source for the instructions executed by the audio processing system.

In the description, certain terminology is used to describe features of various aspects. For example, in certain situations, the terms "renderer", "processor", "mapper", "beamformer", "component," "block," "renderer," "model", "extractor", "selector", and "logic" are representative of hardware and/or software configured to perform one or more functions. For instance, examples of "hardware" include, but are not limited or restricted to an integrated circuit such as a processor (for example, a digital signal processor, microprocessor, application specific integrated circuit, a microcontroller, etc.). Of course, the hardware may be alternatively implemented as a finite state machine or even combinatorial logic. An example of "software" includes executable code in the form of an application, an applet, a routine or even a series of instructions. As mentioned above, the software may be stored in any type of machine-readable medium.

It will be appreciated that the aspects disclosed herein can utilize memory that is remote from the system, such as a network storage device which is coupled to the audio processing system through a network interface such as a modem or Ethernet interface. The buses 162 can be connected to each other through various bridges, controllers and/or adapters as is well known in the art. In one aspect, one or more network device(s) can be coupled to the bus 162. The network device(s) can be wired network devices (e.g., Ethernet) or wireless network devices (e.g., WI-FI, Bluetooth). In some aspects, various aspects described (e.g., extraction of voice and ambience from microphone signals described as being performed at the capture device, or audio and visual processing described as being performed at the playback device) can be performed by a networked server in communication with the capture device and/or the playback device.

Some portions of the preceding detailed descriptions have been presented in terms of algorithms and symbolic representations of operations on data bits within a computer memory. These algorithmic descriptions and representations are the ways used by those skilled in the audio processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio processing system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it is to be understood that such aspects are merely illustrative of and not restrictive on the broad invention, and the invention is not limited to the specific constructions and arrangements shown and described, since various other modifications may occur to those of ordinary skill in the art. The description is thus to be regarded as illustrative instead of limiting.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A method, performed by a computing device, comprising:

generating a plurality of spatial filters that map response of an audio capture device having a plurality of microphones to a plurality of head related transfer functions (HRTFs) fora plurality of positions of the audio capture device relative to the HRTFs;

determining a current set of spatial filters based on the plurality of spatial filters and a head position of a user; and convolving microphone signals with the current set of spatial filters, resulting in output binaural audio channels.

2. The method of claim 1, wherein the output binaural audio channels are generated from the microphone signals without creating an intermediate format.

3. The method of claim 1, wherein determining the current set of spatial filters includes selecting one or more of the plurality of spatial filters as the current set of spatial filters, based on the head position of the user.

4. The method of claim 1, wherein determining the current set of spatial filters includes interpolating one or more of the plurality of spatial filters selected based on the head position of the user, to determine the current set of spatial filters.

5. The method of claim 1, wherein generating the plurality of spatial filters includes discarding a subset of the plurality of spatial filters for where a reproduction error exceeds a threshold and storing the plurality of spatial filters on the computing device or on an external computing device in communication with the computing device.

6. The method of claim 1, wherein the plurality of spatial filters are represented as beamforming filters, and generating the plurality of spatial filters includes a) generating virtual beamformed speakers based on directivity pattern of the plurality of microphones of the audio capture device, b) generating virtual beamformed microphone pickups based on the HRTFs, and c) generating the beamforming filters such that the beamforming filters map the virtual beamformed speakers to the virtual beamformed microphone pickups.

7. The method of claim 1, wherein the head position of the user is generated by one or more sensors integrated with a headphone set or head mounted display.

8. The method of claim 7, wherein the output binaural audio channels are applied to a left speaker and right speaker of the headphone set or the head mounted display, to produce spatial binaural audio.

9. The method of claim 1, wherein each of the plurality of spatial filters corresponds to a different position of the user's head.

10. The method of claim 1, wherein the head position of the user defines at least one of a roll, pitch, or yaw of the user's head.

11. An audio processing system comprising a processor, configured to perform operations including:

generating a plurality of spatial filters that map response of an audio capture device having a plurality of microphones to a plurality of head related transfer functions (HRTFs) for a plurality of positions of the audio capture device relative to the HRTFs;

determining a current set of spatial filters based on the plurality of spatial filters and a head position of a user; and convolving microphone signals with the current set of spatial filters, resulting in output binaural audio channels.

12. The audio processing system of claim 11, wherein the output binaural audio channels are generated from the microphone signals without creating an intermediate format.

13. The audio processing system of claim 11, wherein determining the current set of spatial filters includes selecting one or more of the plurality of spatial filters as the current set of spatial filters, based on the head position of the user.

14. The audio processing system of claim 11, wherein determining the current set of spatial filters includes interpolating one or more of the plurality of spatial filters selected based on the head position of the user, to determine the current set of spatial filters.

15. The audio processing system of claim 11, wherein generating the plurality of spatial filters includes discarding a subset of the plurality of spatial filters for where a reproduction error exceeds a threshold and storing the plurality of spatial filters on the computing device or on an external computing device in communication with the computing device.

16. The audio processing system of claim 11, wherein the plurality of spatial filters are represented as beamforming filters, and generating the plurality of spatial filters includes a) generating virtual beamformed speakers based on directivity pattern of the plurality of microphones of the audio capture device, b) generating virtual beamformed microphone pickups based on the HRTFs, and c) generating the beamforming filters such that the beamforming filters map the virtual beamformed speakers to the virtual beamformed microphone pickups.

17. An electronic device, comprising a processor, configured to perform operations including:

accessing a plurality of spatial filters that map response of an audio capture device having a plurality of microphones to a plurality of head related transfer functions (HRTFs) fora plurality of positions of the audio capture device relative to the HRTFs;

determining a current set of spatial filters based on the plurality of spatial filters and a head position of a user; and convolving microphone signals with the current set of spatial filters, resulting in output binaural audio channels.

18. The electronic device of claim 17, wherein the output binaural audio channels are generated from the microphone signals without creating an intermediate format.

19. The electronic device of claim 17, wherein determining the current set of spatial filters includes selecting one or more of the plurality of spatial filters as the current set of spatial filters, based on the head position of the user.

20. The electronic device of claim 17, wherein determining the current set of spatial filters includes interpolating one or more of the plurality of spatial filters selected based on the head position of the user, to determine the current set of spatial filters.

* * * * *